United States Patent [19]

Porucznik

[11] Patent Number: 5,052,207

[45] Date of Patent: Oct. 1, 1991

[54] APPARATUS FOR, AND A METHOD OF, CUTTING A BLANK

[75] Inventor: Paul Porucznik, Kennington, United Kingdom

[73] Assignee: CMB Foodcan plc, Worcester, United Kingdom

[21] Appl. No.: 544,617

[22] Filed: Jun. 26, 1990

[30] Foreign Application Priority Data

Jul. 26, 1989 [GB] United Kingdom ..... 8917049

[51] Int. Cl.[5] ..... B21D 22/28

[52] U.S. Cl. ..... 72/329; 72/379.4; 83/689

[58] Field of Search ..... 72/327, 329, 330, 336, 72/337, 379.4; 83/55, 175, 176, 689

[56] References Cited

U.S. PATENT DOCUMENTS

| | | | |
|---|---|---|---|
| 3,060,992 | 10/1962 | Hopp et al. | 72/327 |
| 3,656,394 | 4/1972 | McCutcheon | 83/689 |
| 3,724,305 | 4/1973 | Kondo | 83/55 |
| 3,996,832 | 12/1976 | Schubert . | |
| 4,277,891 | 7/1981 | Dick . | |
| 4,362,078 | 12/1982 | Ohnishi et al. . | |

FOREIGN PATENT DOCUMENTS

| | | | |
|---|---|---|---|
| 402120 | 9/1924 | Fed. Rep. of Germany . | |
| 1928697 | 12/1970 | Fed. Rep. of Germany . | |
| 1602491 | 7/1971 | Fed. Rep. of Germany . | |
| 1761581 | 7/1971 | Fed. Rep. of Germany . | |
| 2144524 | 3/1973 | Fed. Rep. of Germany . | |
| 2418703 | 9/1979 | France . | |
| 58927 | 4/1982 | Japan | 72/337 |
| 5897433 | 6/1983 | Japan . | |
| 59118232 | 7/1984 | Japan . | |
| 61172629 | 8/1986 | Japan . | |
| 963856 | 7/1964 | United Kingdom . | |

OTHER PUBLICATIONS

Notes on Citations

*Primary Examiner*—Lowell A. Larson
*Attorney, Agent, or Firm*—Christie, Parker & Hale

[57] ABSTRACT

When a blank is cut from metal sheet which suffers from crystallographic anisotropy, there is a tendency for ears to be formed during subsequent forming operations, such as drawing or pressing. In order to compensate for this tendency, there may be used a metal blank which is not completely round, but has lobes at positions to cancel at least some of the valleys between the ears. There is described a punch and die which may be used to form such a lobed blank. The punch has four circumferentially extending lobe-forming sections. Each lobe-forming section is constructed by forming a stepped recess in the cutting edge of the punch. In each lobe-forming section, the depth of the recess varies from a maximum at the middle of the section to zero at the ends. The die is conventional.

13 Claims, 7 Drawing Sheets

APPARATUS FOR, AND A METHOD OF, CUTTING A BLANK

FIELD OF THE INVENTION

This invention relates to an apparatus for, and a method of, cutting a blank from metal strip or sheet.

BACKGROUND AND SUMMARY OF THE INVENTION

The operations which are used to form metal strip or sheet may cause crystallographic anisotropy. Such crystallographic anisotropy arises mainly from rolling and annealing. During a rolling operation, there is a tendency for the metal crystals to adopt a preferred orientation. In the recrystallisation which occurs in a subsequent annealing operation, there is a tendency for the metal crystals to adopt another preferred orientation. Such crystallographic anisotropy leads to anisotropy in the stress-strain relationships in the metal strip or sheet. When a blank cut from metal strip or sheet is subjected to forming operations, such as drawing, wall ironing or pressing, strain variations lead to the formation of ears and valleys between the ears.

There will now be described three forming processes used in the manufacture of metal cans, each of which results in a workpiece exhibiting ears.

In the first process, a metal can body is formed from a circular blank cut from metal strip by subjecting the blank to a drawing operation followed by one or more redrawing operations. An example of the shape of a typical can body 10 following a second redrawing operation is shown in FIGS. 1 and 2. As may be seen, the can body has a seaming flange 12 and the flange 12 has four ears 14 which are caused by the anisotropy of the metal strip. Between each pair of adjacent ears 14, there is a valley. As the presence of the ears 14 would prevent the formation of a satisfactory seam with a can cover, the seaming flange 12 is trimmed back to the shape indicated by circular line 16. Consequently, the presence of ears 14 creates the need to perform a trimming operation and results in the wastage of the material removed in the trimming operation.

The number of ears exhibited by a can body after a second redrawing operation depends partly upon the nature of the operation used to form the metal sheet from which the blank is cut, and partly upon the type of metal used. Three common patterns are illustrated in FIGS. 3*a*,3*b*,4*a*,4*b*,5*a* and 5*b*. In FIGS. 3*a*,4*a*,5*a*, there are shown circular blanks 20,22,24 cut from sheet metal 26,28,30. In each of these figures, the rolling direction used to form the sheet metal is indicated by an arrow R and the directions in which the ears are formed are indicated by arrows E. Plan views of can bodies 32,34,36 formed, respectively, from blanks 20,22,24 are shown in FIGS. 3*b*,4*b*,5*b*. In these figures, ears are indicated by reference numeral 38.

In the example shown in FIGS. 3*a*,3*b*, ears are formed at 45°, 135°,225° and 315° relative to the rolling direction. In the example shown in FIGS. 4*a*, 4*b*, ears are formed at 0°, 90°, 180° and 270° relative to the rolling direction. In the example shown in FIGS. 5*a*,5*b*, ears are formed at 0°, 60°, 120°, 180°, 240° and 300° relative to the rolling direction. In each example, there is a valley between each pair of adjacent ears.

In the second process used in the manufacture of metal cans, a metal can body is formed from a metal blank by a drawing operation, a redrawing operation and a wall ironing operation. In each of the drawing and redrawing operations, the workpiece is driven by a punch through a die and then removed from the punch by a stripper. In the wall ironing operation, the workpiece is driven by a punch through one or more wall ironing dies and then removed by a stripper. A perspective view of a can body 40 having ears 42 after a wall ironing operation is shown in FIG. 6. Between each pair of adjacent ears 42, there is a valley. The ears 42 have to be removed by a trimming operation and this causes wastage of material. After the wall ironing operation, the ears tend to interfere with normal operation of the stripper and such interference can cause the wall of the can body to buckle.

In the third process, a can cover is formed from a circular metal blank by a drawing operation and one or more redrawing operations. In FIG. 7, there is shown the peripheral part of a typical cover 44. The cover 44 includes a chuck wall 46, a seaming panel 48 and a cover curl 50. Ears are normally present in the free ends of the cover curl 50 and it is not usually possible to remove the ears with a trimming operation. In order to connect the cover 44 to a can body, the cover 44 is placed on the free end of a can body. The seaming panel 48 of the cover 44 and the seaming flange of the can body are then interlocked in a first seaming operation. The seaming panel and seaming flange are then squeezed together in a second seaming operation to form a double seam.

A typical double seam 52 is shown in FIG. 8. The double seam 52 includes a cover hook 54 and a body hook 56 having an overlap 58. The integrity of the double seam depends upon the length of this overlap 58. The presence of ears in the cover curl causes a variation in the length of the overlap 58. Usually, the sizes of the seaming panel and flange are sufficient to ensure that the minimum length of the overlap 58 is adequate to achieve a double seam of high integrity. However, for some applications, there is a requirement to make the dimensions of the double seam as small as possible. The presence of ears in the cover curl places a restriction on the minimum dimensions that may be achieved.

From the foregoing, it may be appreciated that the formation of ears leads to many problems.

One method of compensating for the formation of ears and valleys is to use a metal blank which is not quite round, but has a number of lobes, for example four, six or eight as may be appropriate, aligned to cancel the ear and valley forming properties of the metal sheet. The lobes of the blank fill the valleys between the ears.

In a known method of cutting lobed blanks, there are used a matched punch and die which have been ground to a lobed shape. This method suffers from the disadvantages that the punch and die are difficult to produce and it is difficult and time consuming to set the punch and die in the blanking apparatus as the lobes of the punch and die must be accurately aligned with each other.

It is an object of this invention to provide a new or improved apparatus for, and a new or improved method of, cutting a blank from metal strip of sheet.

According to one aspect of this invention, there is provided an apparatus for cutting a blank from metal strip or sheet, said apparatus comprising a punch having a cutting edge and a die having a cutting edge which is arranged to cooperate with the cutting edge of the punch, in which a plurality of circumferentially extending lobe-forming sections are provided in the cutting edge of said punch, each lobe-forming section being constructed by forming a recess in the cutting edge of said punch, said punch and die being arranged to cooperate to produce a blank having lobes at positions corresponding to the positions of said lobe-forming sections.

When making the punch and die for the apparatus of this invention, the only additional step that is required in comparison with the manufacture of a conventional punch and die is the formation of recesses in the cutting edge of the punch. When using the apparatus, the punch and die can be used in existing machines. When a blank is cut, the recesses in the cutting edge of the punch causes lobes to be formed.

According to another aspect of this invention, there is provided a method of cutting a blank from metal strip or sheet comprising the steps of taking a punch having a cutting edge and a die having a cutting edge which is arranged to cooperate with the cutting edge of the punch, a plurality of circumferentially extending lobe-forming sections being provided in the cutting edge of said punch and each lobe-forming section being constructed by forming a recess in the cutting edge of said punch, placing the metal strip or sheet between the punch and the die, and causing the punch and the die to cooperate so as to cut a blank from the metal strip or sheet, said blank having lobes at positions corresponding to the positions of said lobe-forming sections.

BRIEF DESCRIPTION OF THE DRAWINGS

This invention will now be described in more detail, by way of example, with reference to the drawings in which.

DETAILED DESCRIPTION OF PREFERRED EMBODIMENTS OF THE INVENTION

Figure 1:
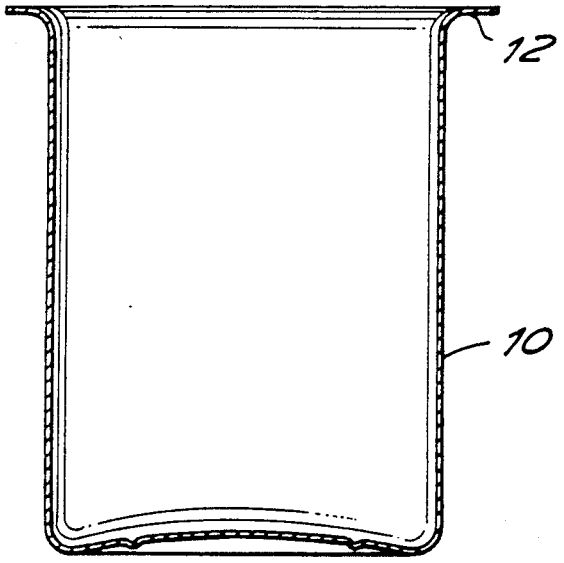
FIG. 1 PRIOR ART
FIG. 1 is a cross-sectional view of a can body formed by drawing and redrawing operations.
Figure 2:
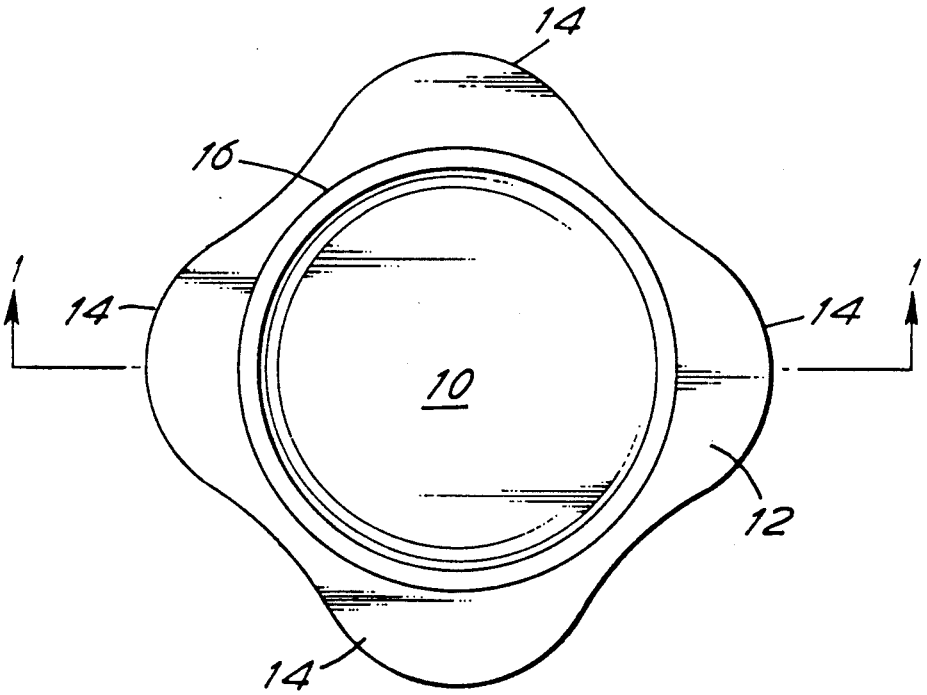
FIG. 2 PRIOR ART
FIG. 2 is a plan view of the can body of FIG. 1.
Figure 3A:
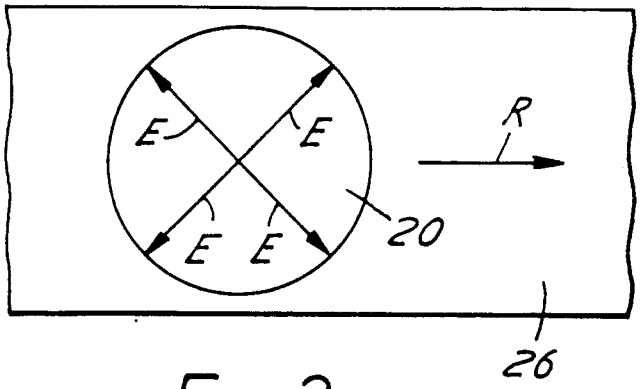
FIG. 3a PRIOR ART
FIGS. 3*a*,4*a*,5*a*, show three blanks cut from sheet metal.
Figure 3B:
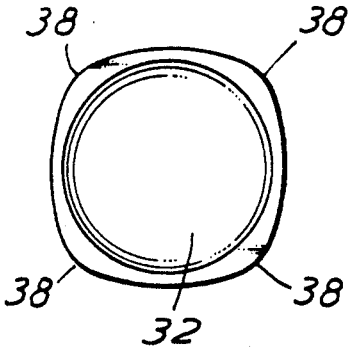
FIG. 3b PRIOR ART
FIGS. 3*b*,4*b*,5*b* show can bodies formed, respectively, from the blanks of FIGS. 3*a*,4*a*,5*a*.
Figure 4A:
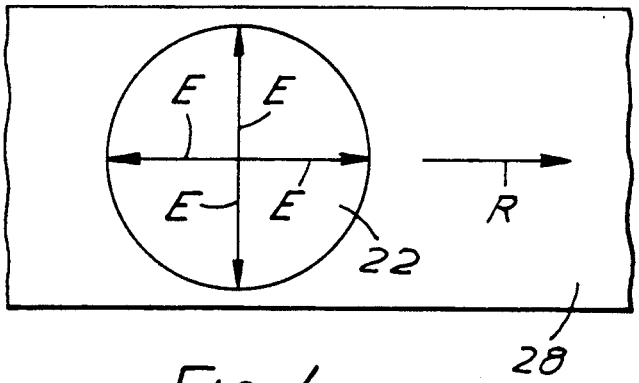
FIG. 4a PRIOR ART
Figure 4B:
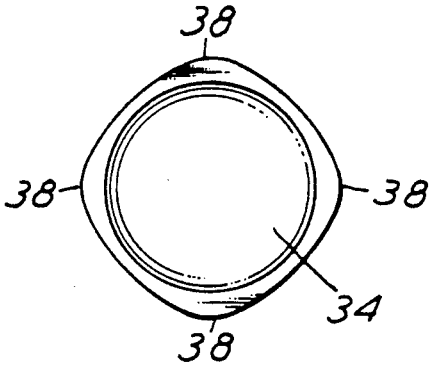
FIG. 4b PRIOR ART
Figure 5A:
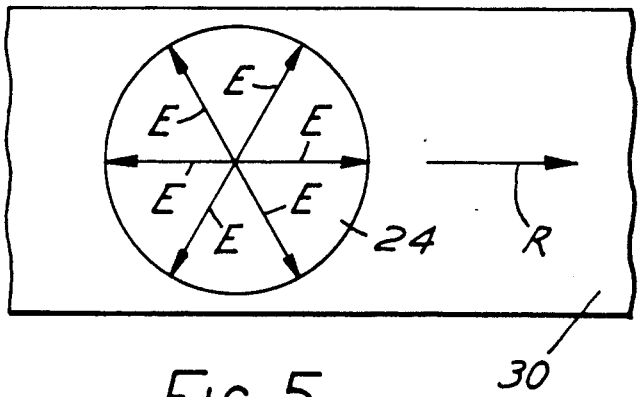
FIG. 5a PRIOR ART
Figure 5B:
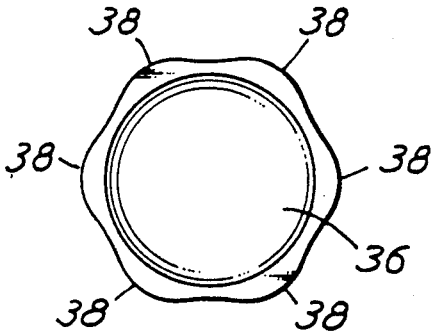
FIG. 5b PRIOR ART
Figure 6:
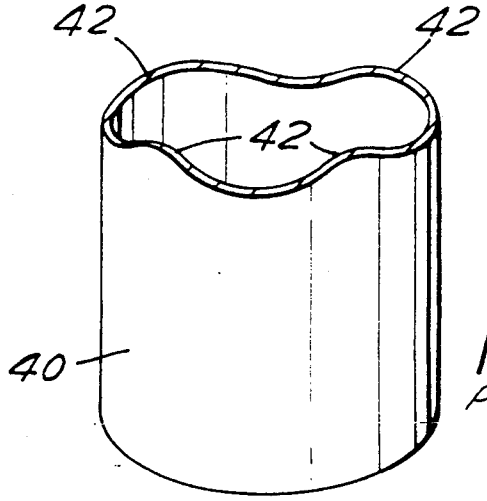
FIG. 6 PRIOR ART
FIG. 6 is a perspective view of a can body formed by drawing, redrawing and wall ironing operations.
Figure 7:
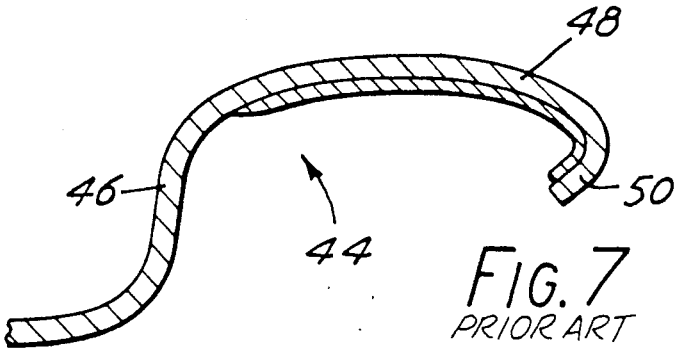
FIG. 7 PRIOR ART
FIG. 7 is a cross-sectional view of a peripheral part of a can cover.
Figure 8:
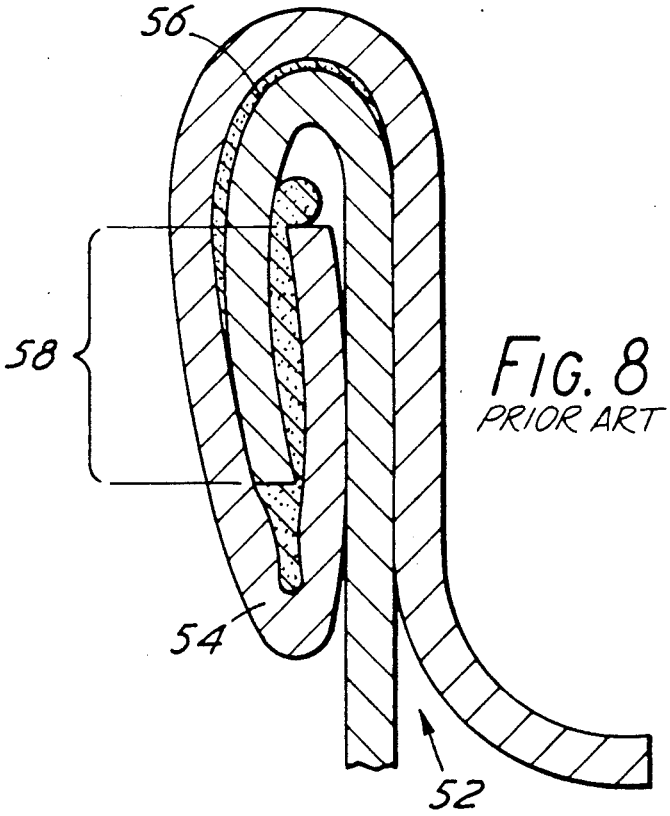
FIG. 8 PRIOR ART
FIG. 8 is a cross-sectional view of a double seam.
Figure 9:
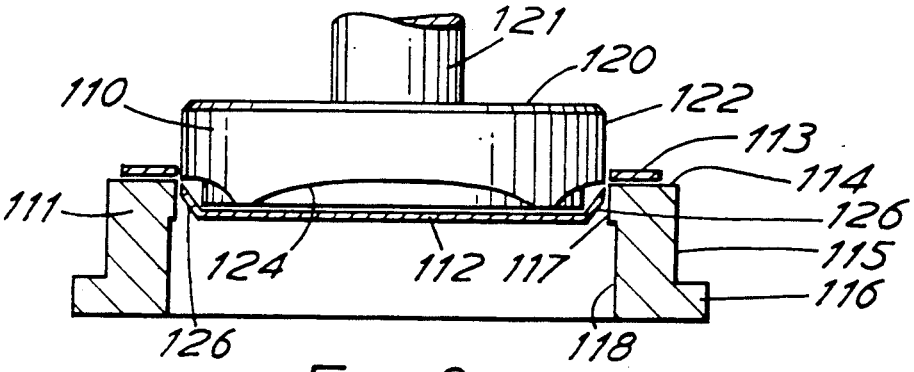
FIG. 9 is a side view, partly in section, of a punch and die used in an apparatus for cutting a blank embodying this invention.
Figure 10:
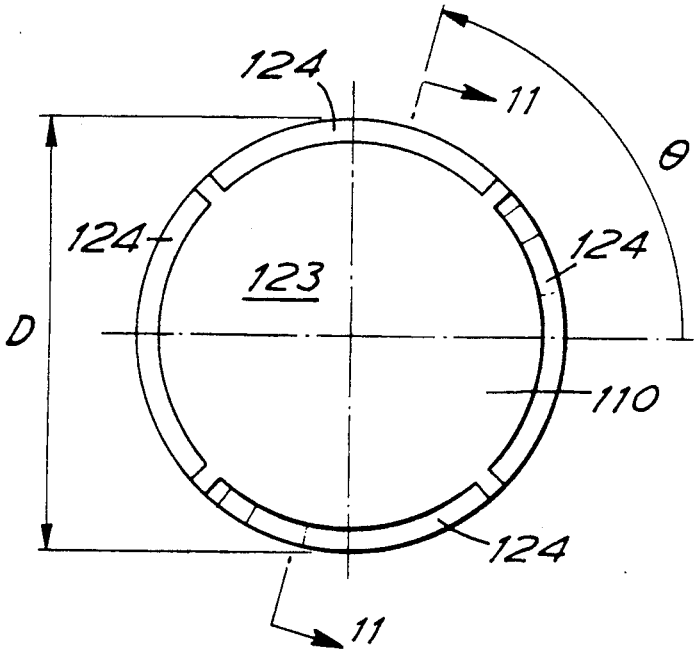
FIG. 10 is an underneath view of the punch shown in FIG. 9.
Figure 11:
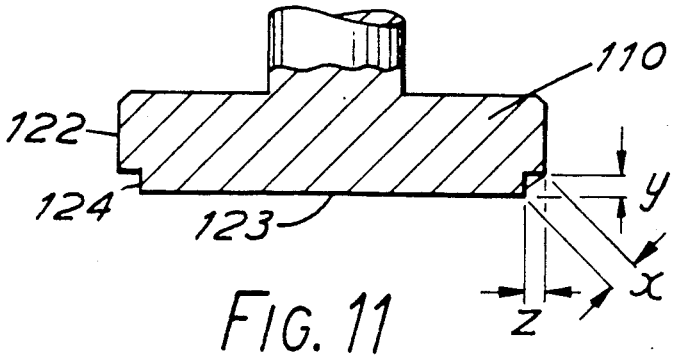
FIG. 11 is a cross-sectional view of the punch taken on the line 11—11 of FIG. 10.

Referring to FIGS. 9 to 11, there is shown a punch 110 and die 111 forming part of a blanking apparatus. In FIG. 9, the punch 110 and die 111 are shown cutting a blank 112 from metal sheet 113.

The die 111, which is of conventional design, has a generally annular shape. The outer surface of die 111 includes an annular face 114, a cylindrical part 115 and a collar 116, which serves to locate the die 111 in the blanking apparatus. The inner surface of die 111 is of stepped cylindrical configuration and comprises a land part 117 and a recessed part 118. The annular face 114 and the land part 117 meet at a circular cutting edge.

The punch 110 has a generally cylindrical shape and its surface comprises a flat upper face 120 joined to a ram 121, a cylindrical part 122 and a lower face 123. The cylindrical part 122 has a diameter D and is complimentary to the land part 117 of die 111. The cylindrical part 122 and lower face 123 meet at the cutting edge.

Figure 12:
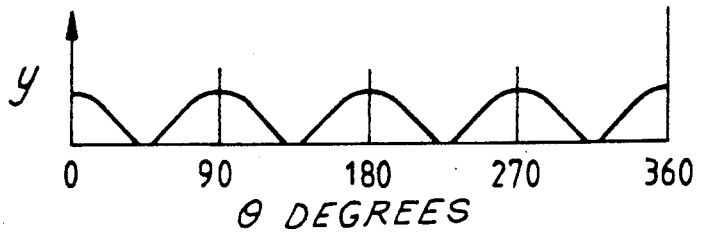
FIG. 12 is a graph illustrating the shape of a set of recesses formed in the punch of FIG. 9.

Four lobe-forming sections 124 are provided in the cutting edge of punch 110. Each lobe-forming section 124 is constructed by forming a recess in the cutting edge. Each recess extends circumferentially around the cutting edge through an angle slightly less than 90° and the lobe-forming sections are spaced from each other by portions of the cutting edge in which no recess is formed. As shown in FIG. 11, each recess has a stepped configuration. Each recess has a constant width z. However, as shown by the graph in FIG. 12, the depth y of the recess varies. More specifically, each recess has two straight portions joined by a radiused portion. However, the exact shape of the recesses is not critical and, by way of alternative, the depth may vary in a sinusoidal manner. In each lobe-forming section 124, the area in cross-section which is absent from the cutting edge of the punch 110 by virtue of the recess increases progressively from the ends of the lobe-forming section towards the middle thereof.

FIG. 9 shows a blank 112 being cut from metal sheet 113 using the punch 110 and die 111. As the punch 110 moves downwardly, in each lobe-forming section, the lower surface 123 of the punch 110 engages the metal sheet 113 before the metal sheet 113 is engaged by the cutting edge of the punch 110. Consequently, the recesses of the four lobe-forming sections 124 cause four lobes 126 to be formed. Each of the lobes 126 is bent upwardly from the general plane of the blank 112.

Figure 13:
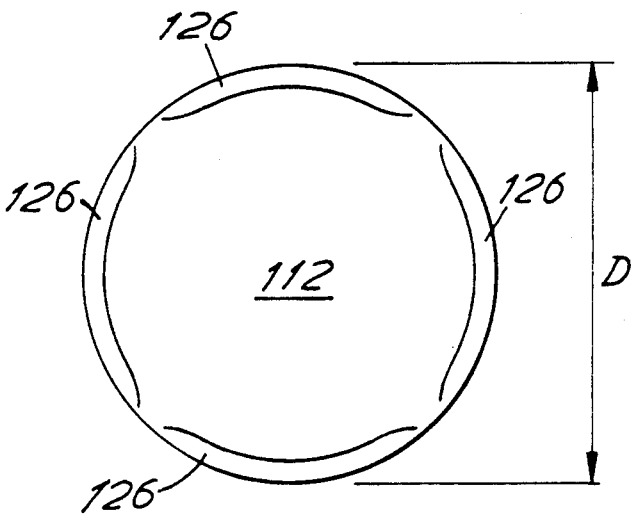
FIG. 13 is a plan view of a blank cut with the punch and die of FIG. 9.
Figure 14:
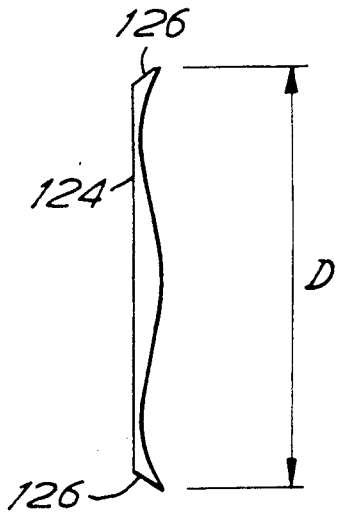
FIG. 14 is a side view of the blank of FIG. 13.
Figure 15:
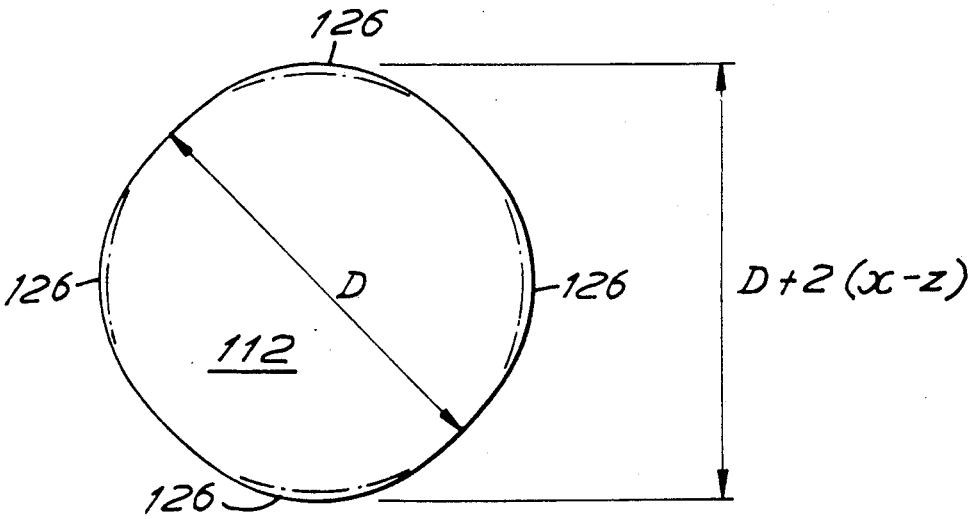
FIG. 15 is a plan view of the blank FIG. 13 after it has been flattened.

An example of a blank 112 is shown in FIGS. 13 to 15. As may be observed, both in plan view and in end view, the blank 112 has a constant diameter D which is equal to the diameter of the cylindrical part 122 of punch 110. As shown in FIG. 15, when the blank 112 is flattened out, its diameter varies between a minimum value D and a maximum $D+2(x-z)$, where x is given by $\sqrt{(y^2+z^2)}$.

The punch 110 and die 111 are suitable for use with metal sheet which has a tendency to produce four ears and four valleys in a workpiece during forming operations subsequent to blanking. When so used the punch 110 is oriented relative to the metal sheet so that the four lobes are formed at positions where valleys would otherwise be formed. The maximum depth of the recess in each lobe-forming section should be chosen so as to cancel the valleys as exactly as possible. For a particular application, the depth of the recess will depend upon the properties of the metal sheet and the nature of the forming operations to which the blanks are subjected.

More generally, when it is desired to produce lobed blanks to compensate as completely as possible for earing, there may be used a punch generally similar to punch 110 but in which the number of lobe-forming sections is equal to the number of valleys that would otherwise be produced.

In the punch described with reference to FIGS. 9 to 12, the width of each recess is constant but the depth varies. By way of one alternative, the depth may be constant while the width varies. By way of another alternative, both the depth and the width of each recess may vary together from maximum values at the middle of a lobe-forming section to zero at the ends thereof. In the punch described with reference to FIGS. 9 to 12, each recess has a stepped configuration. However, different shapes may be used. By way of an alternative, each recess may be formed with a plane which is oriented at 10° to the lower face of the punch.

The punch and die which have been described with reference to FIGS. 9 to 12 are suitable for cutting blanks which are subsequently subjected to a variety of forming operations. Such forming operations may include drawing, redrawing, wall ironing and pressing.

The punch and die described with reference to FIGS. 9 to 12 are suitable for cutting blanks which are subsequently formed into various products. By way of one example, a blank cut with the punch and die of FIGS. 9 to 12 may be formed into a can body by a drawing operation followed by one or more redrawing operations. By way of another example, such a blank may be formed into a can body by a drawing operation, a redrawing operation and a wall ironing operation. By way of a further example, such a blank may be formed into a can cover by a drawing operation followed by two redrawing operations. Conventional apparatus may be used for performing the drawing, redrawing and wall ironing operations.

Although the punch 10 has been described with reference to a blanking apparatus, a punch and die embodying the present invention may form part of an apparatus which is capable of performing operations subsequent to blanking during a single stroke of the apparatus. For example, a punch and die embodying the present invention may form part of an apparatus which performs a drawing operation, a redrawing operation and a wall ironing operation following a blanking operation during a single stroke of the apparatus. When a punch and die embodying this invention are used in such an apparatus, the punch is provided with lobe-forming sections in the manner described above but the remaining parts of the apparatus have a conventional design.

When a blank cut from metal strip is subjected to forming operations, there may be produced a workpiece in which the ears and valleys are equal in size. Examples of such workpieces have been discussed with reference to FIGS. 1 to 6. However, with some types of metal strip, there are produced ears and valleys of unequal size. In general, the relative sizes of the ears and valleys depend on the nature of the anisotropy in the metal strip.

Where the nature of the anisotropy is such that there are produced ears and valleys of unequal size, compensation may be provided by forming a blank with lobes of unequal size. The punch 110 shown in FIGS. 9 to 11 may be used to produce such a blank by modifying the depths of the recesses in the lobe-forming sections.

Figure 18:
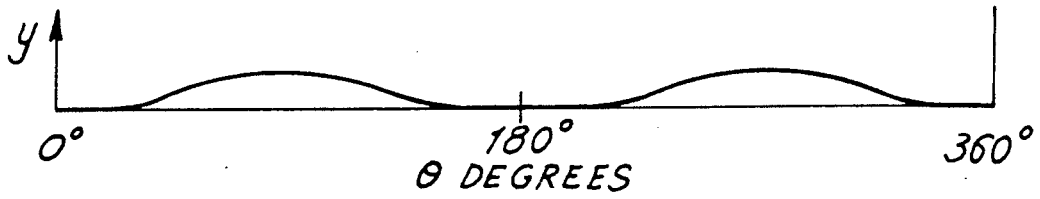
FIG. 18 is a graph illustrating the shape of the recesses formed in the punch of FIG. 16.
Figure 19:
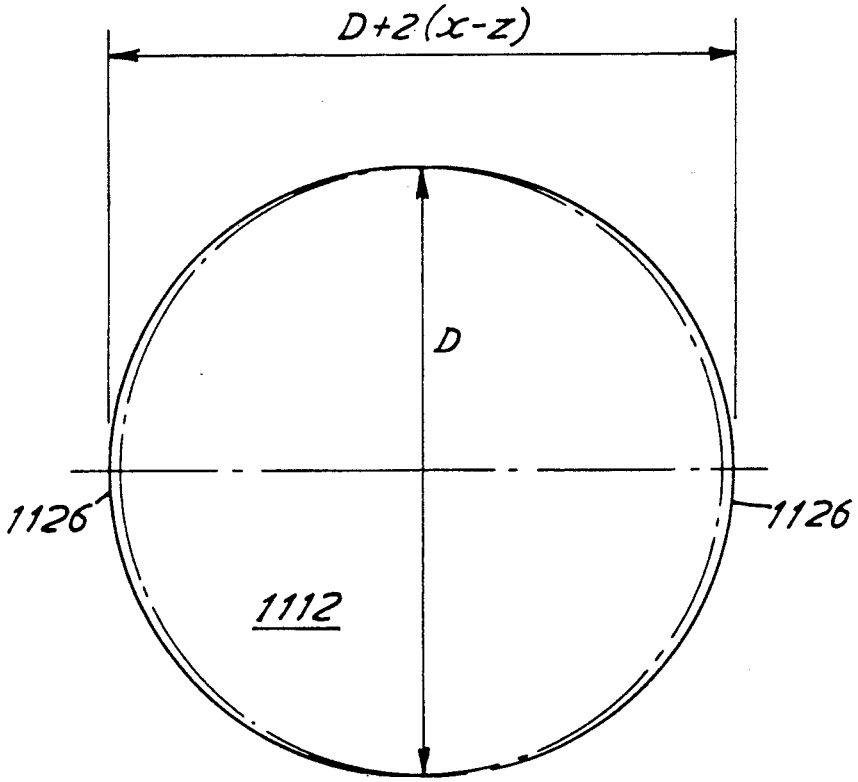
FIG. 19 is a plan view of a flattened out blank formed using the punch of FIG. 16.

The nature of the anisotropy can be such that a workpiece formed from a circular blank has large valleys which would benefit from compensation and small valleys for which compensation is not necessary. In order to provide compensation when using metal strip having this type of anisotropy, it is sufficient to form lobes in the blank only at positions corresponding to the large valleys. For example, if a circular blank produces a workpiece with two large valleys diametrically opposite to each other and two small valleys diametrically opposite to each other, adequate compensation for the valleys may be obtained by providing two lobes in the blank at positions diametrically opposite to each other. The lobes are located at positions where the large valleys would otherwise be formed. A punch 1110 which is capable of producing a blank with two such lobes will now be described with reference to FIGS. 16 to 18 and a blank 1112 produced with the punch 1110 is shown in FIG. 19.

FIGS. 16 to 19 are generally similar to FIGS. 10, 11, 12 and 15 and like parts and features have been denoted by the same reference numerals preceded by the number "1".

Figure 16:
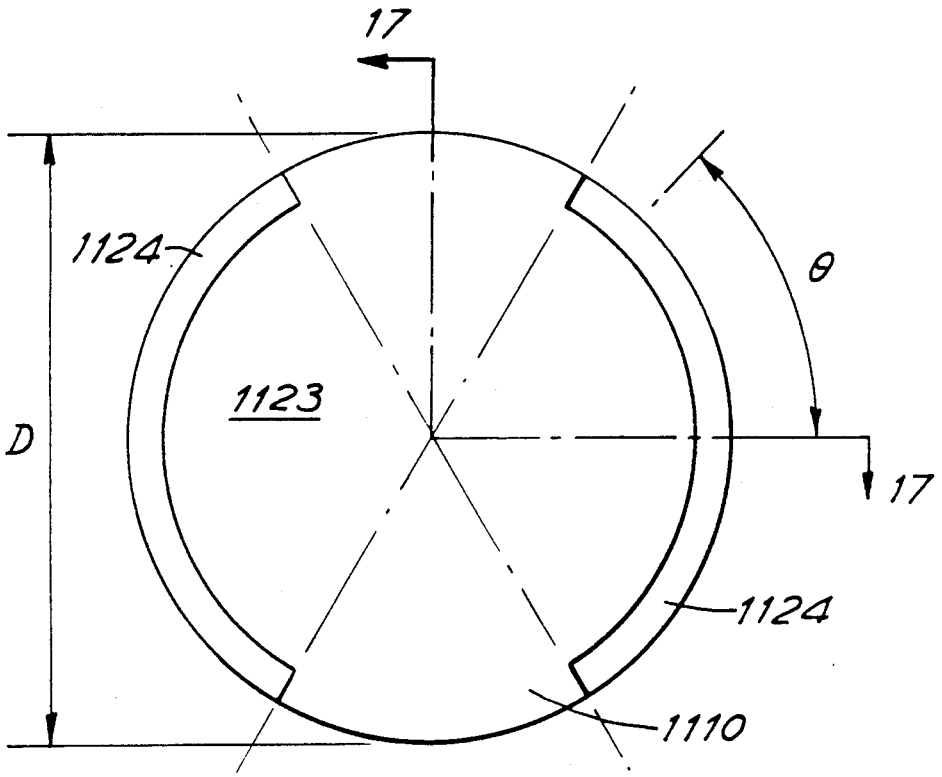
FIG. 16 is an underneath view of another punch for use in an apparatus embodying this invention.
Figure 17:
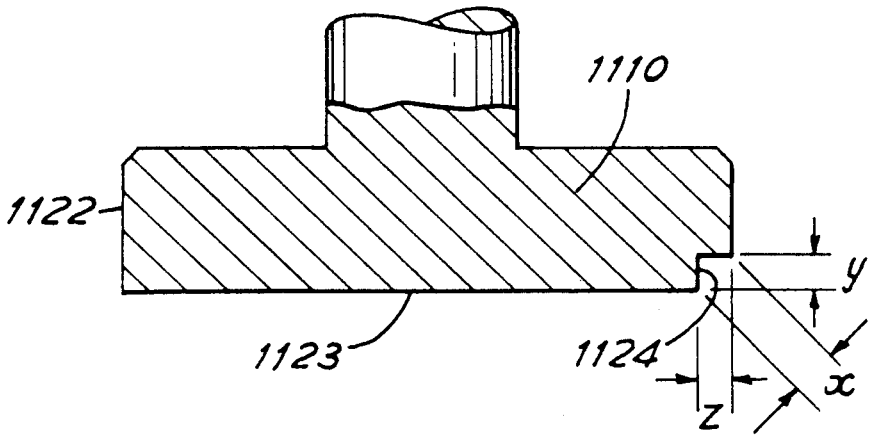
FIG. 17 is a cross-sectional view on the line 17—17 of FIG. 16.

As may be seen in FIGS. 16 and 17, the punch 1110 has two diametrically opposite lobe-forming sections 1124. The variation of the depth of the recesses in the lobe-forming sections is shown in FIG. 18. In FIG. 19, there is shown a blank 1112 produced by the punch 1110 and this blank has two diametrically opposite lobes 1126.

In this specification, the expression "metal strip or sheet" should be interpreted to include strip or sheet material formed by laminating metal and plastics layers.

What is claimed is:

1. An apparatus for cutting a blank from metal strip or sheet, said apparatus comprising a punch having a substantially circular cutting edge and a die having a substantially circular cutting edge which is arranged to cooperate with the cutting edge of the punch, in which a plurality of circumferentially extending spaced-apart lobe-forming sections are provided in the cutting edge of said punch, each lobe-forming section being constructed by forming a radial recess in the cutting edge of said punch, the recess defining an arc of less than 180 degrees, said punch and die being arranged to cooperate to produce a blank having lobes at positions corresponding to the positions of said lobe-forming sections.

2. Apparatus as claimed in claim 1 in which, in each lobe-forming section, the area in cross-section which is absent from said punch by virtue of the recess increases progressively from the ends of the lobe-forming section towards the middle thereof.

3. An apparatus as claimed in claim 2 in which, in each lobe-forming section, the recess has a stepped shape in cross-section.

4. An apparatus as claimed in claim 3 in which, in each lobe-forming section, the width of the recess is substantially constant while the depth of the recess increases progressively from the ends of the lobe-forming section towards the middle thereof.

5. An apparatus as claimed in claim 3 in which, in each lobe-forming section, the depth of the recess is constant while the width of the recess increases progressively from the ends of the lobe-forming section towards the middle thereof.

6. An apparatus as claimed in any one of claims 1 to 3 in which the lobe-forming sections are spaced from each other by parts of the cutting edge of said punch in which a recess is not formed.

7. A method of cutting a blank from metal strip or sheet comprising the steps of taking a punch having a substantially circular cutting edge and a die having a substantially circular cutting edge which is arranged to cooperate with the cutting edge of the punch, in which a plurality of circumferentially extending spaced-apart lobe-forming sections are provided in the cutting edge of said punch, each lobe-forming section being constructed by forming radial recess in the cutting edge of said punch, the recess defining an arc of less than 180 degrees, placing the metal sheet between the punch and the die, orienting the punch relative to the metal sheet so that the lobes are formed in the blank at positions which compensate for valleys formed during subsequent metal working operations, and causing the punch and die to cooperate so as to cut a blank from the metal strip or sheet, said blank having lobes at positions corresponding to the positions of said lobe-forming sections.

8. A method as claimed in claim 7 in which, in each lobe-forming section, the area in cross-section which is absent from said punch by virtue of the recess increases progressively from the edge of the lobe-forming section towards the middle thereof.

9. A method as claimed in claim 7 in which, the lobe-forming sections are spaced from each other by parts of the cutting edge of said punch in which a recess is not formed.

10. A method as claimed in claim 7 in which the blank is subsequently subjected to a drawing operation.

11. A method as claimed in claim 7 in which the blank is subsequently formed from a can body by a drawing operation and one or more redrawing operations.

12. A method as claimed in claim 7 in which the blank is subsequently formed into a can body by a drawing operation, a redrawing operation, and one or more wall ironing operations.

13. A method as claimed in claim 7 in which the blank is subsequently formed into a can cover by a drawing operation and one or more redrawings operations.

* * * * *